United States Patent [19]

Nolan

[11] 4,300,069

[45] Nov. 10, 1981

[54] COLOR PICTURE TUBE HAVING IMPROVED SLIT TYPE SHADOW MASK AND METHOD OF MAKING SAME

[75] Inventor: Richard A. Nolan, Lancaster, Pa.

[73] Assignee: RCA Corporation, New York, N.Y.

[21] Appl. No.: 104,823

[22] Filed: Dec. 18, 1979

[51] Int. Cl.[3] ..... H01J 29/80

[52] U.S. Cl. ..... 313/403; 313/408

[58] Field of Search ..... 313/403, 408

[56] References Cited

U.S. PATENT DOCUMENTS

| | | | |
|---|---|---|---|
| 3,882,347 | 5/1975 | Suzuki et al. | 313/408 X |
| 3,883,770 | 5/1975 | Yamada et al. | 313/403 |
| 3,916,243 | 10/1975 | Brown | 313/403 |
| 3,944,867 | 3/1976 | Kaplan | 313/403 |
| 3,973,965 | 8/1976 | Suziki et al. | 313/403 X |
| 4,131,822 | 12/1978 | Branton | 313/403 |
| 4,168,450 | 9/1979 | Yamauchi et al. | 313/403 |

*Primary Examiner*—Stanley T. Krawczewicz

*Attorney, Agent, or Firm*—Eugene M. Whitacre; Glenn H. Bruestle; Dennis H. Irlbeck

[57] ABSTRACT

A color picture tube having a slit type apertured mask, wherein the slit apertures are arranged in columns and the apertures in each column are separated by webs is improved by constructing the mask with portions of full thickness and portions of reduced thickness. The portions of full thickness consist of strips between the aperture columns and islands at the webs. The strips and islands are separated from each other by the portions of reduced thickness. The cross-sectional area of each web is substantially uniform across the web.

8 Claims, 14 Drawing Figures

COLOR PICTURE TUBE HAVING IMPROVED SLIT TYPE SHADOW MASK AND METHOD OF MAKING SAME

BACKGROUND OF THE INVENTION

This invention relates to color picture tubes and particularly to such tubes having a slit type apertured shadow mask.

Shadow mask type color picture tubes usually include a screen of red, green and blue emitting phosphor lines or dots, electron gun means for exciting the screen and a shadow mask interposed between the gun means and the screen. The shadow mask is a thin multiapertured sheet of metal precisely disposed adjacent the screen so that the mask apertures are systematically related to the phosphor lines or dots.

Color picture tubes having shadow masks with slit shaped apertures have received relatively recent commercial acceptance. One of the reasons for this acceptance is that the percentage of electron beam transmission through the mask can be made higher for a slit mask, line screen type of tube than for a circular apertured mask, dot screen type tube. Even though the use of a slit mask provides a definite advantage in electron beam transmission, the percentage of electron beam transmission through a slit mask can be increased even further than is practiced in the present art.

In one type of slit shadow mask, the mask has vertically extending slit apertures which are interrupted by a plurality of spaced bridges or webs which provide mechanical rigidity. The presence of these webs, however, reduces electron beam transmission and thus also reduces luminescent brightness. On the other hand, the webs serve the useful function of providing mechanical strength to the mask during its formation into a domed shape. Thus because of the desirability of both increased electron beam transmission and mask strength, the web shape and/or size is usually a compromise between both of these factors. A problem therefore exists of how to increase electron beam transmission without affecting the mechanical strength needed for mask formation and subsequent handling.

SUMMARY OF THE INVENTION

A color picture tube having a slit type apertured mask, wherein the slit apertures are arranged in columns and the apertures in each column are separated by webs is improved by constructing the mask with portions of full thickness and portions of reduced thickness. The portions of full thickness consist of strips between the aperture columns and islands at the webs. The strips and islands are separated from each other by the portions of reduced thickness. The cross-sectional area of each web is substantially uniform across the web.

DETAILED DESCRIPTION OF THE PREFERRED EMBODIMENTS

Figure 1:
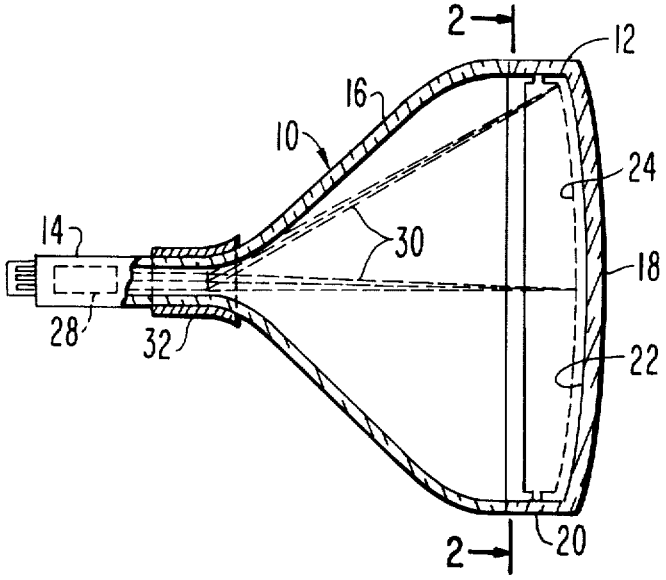
FIG. 1 is a plan view, partly in axial section, of an apertured shadow mask type color picture tube.
Figure 2:
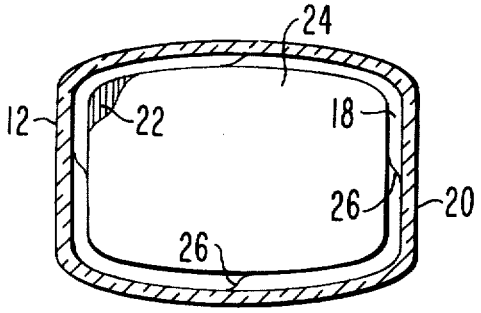
FIG. 2 is a rear view, partly cut away of a tube faceplate assembly taken at lines 2—2 of FIG. 1.

FIGS. 1 and 2 illustrate a rectangular color picture tube having a glass envelope 10 comprising a rectangular faceplate panel or cap 12 and a tubular neck 14 connected by a rectangular funnel 16. The panel 12 comprises a viewing faceplate 18 and a peripheral flange or sidewall 20 which is sealed to the funnel 16. A mosaic three-color phosphor screen 22 is carried by the inner surface of the faceplate 18. The screen 22 is a line screen with the phosphor lines extending substantially parallel to the central vertical axis of the tube (normal to the plane of FIG. 1). An improved novel domed multi-apertured color selection electrode or shadow mask 24 is removably mounted within the panel 12 by four springs 26 in predetermined spaced relation to the screen 22. An inline electron gun 28, shown schematically by dotted lines in FIG. 1, is centrally mounted within the neck 14 to generate and direct three electron beams 30 along coplanar convergent paths through the mask 24 to the screen 22. The mask 24 serves a color selection function by shadowing, or masking, each electron beam from the nonassociated color emitting phosphor lines, while permitting them to strike their associated lines. A magnetic deflection yoke 32 is positioned on the envelope 10 near the intersection of the funnel 16 and the neck 14. When suitably energized, the yoke 32 causes the electron beams 30 to scan the screen 32 in a rectangular raster.

Figure 3:
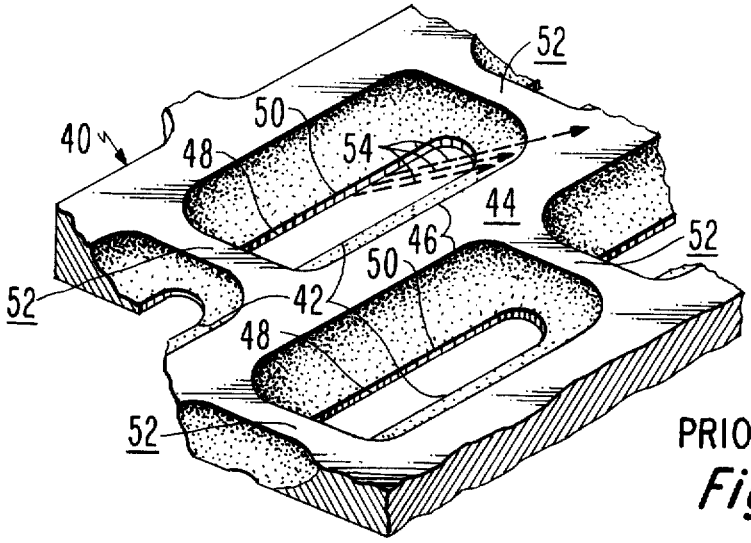
PRIOR ART Fig. 3.
FIG. 3 is a partial perspective view of a prior art shadow mask.

FIG. 3 shows a small portion of a prior art shadow mask 40 having an array of elongated slit apertures 42 therein. The apertures 42 are aligned in columns and the apertures in one column are staggered with respect to the apertures in adjacent columns. On one surface 44 of the mask 40, the apertures 42 have a large opening 46 and on the other surface they have a smaller opening 48. The narrowest restriction 50 in an aperture, called the throat, in this embodiment is very close to the mask surface having the smaller opening 48. In other embodiments this, throat may be nearer the center of the mask. The apertures 42 are formed by coating both sides of the mask material with a photoresist and then by exposing both sides through photomasters having related aperture patterns. Thereafter, the photoresist is developed and the apertures are etched through the mask from both sides. The aperture pattern on one photomaster has aperture shapes much wider than the aperture shapes on the other photomaster thereby permitting the formation of the larger openings 46 on the one surface 44 than on the other surface of the mask 40. The portion of the mask between two adjacent apertures within a particular column is called a bridge or web 52. In the prior art embodiment shown, these webs 52 are full thickness, having not been etched. The purpose of the webs is to provide mask strength when the mask is formed into a domed shape. It is desirable to make these webs as narrow as possible, measured in the direction of the columns, so as to allow maximum transmission of the electron beams through the mask. However, if the webs are made too narrow, mask strength is sacrificed and the mask may tear during forming. Therefore, the dimensions of the webs represent a compromise between mask transmission and mask strength. A mask improvement in accordance with the present invention permits uniform forming of the mask into a domed shape and maintains the desired mask strength while increasing mask transmission off the two major mask axes. To understand the improvement, however, it first is necessary to understand a problem associated with using the prior art mask 40. Three rays 54 of an electron beam are shown in FIG. 3 as they would pass through an aperture 42 located on a mask diagonal. Two of these rays are shown striking a portion of the web 52 and only one ray passes over the web 52. One purpose of the present invention is to permit passage of all three of these rays through the mask.

Figure 4:
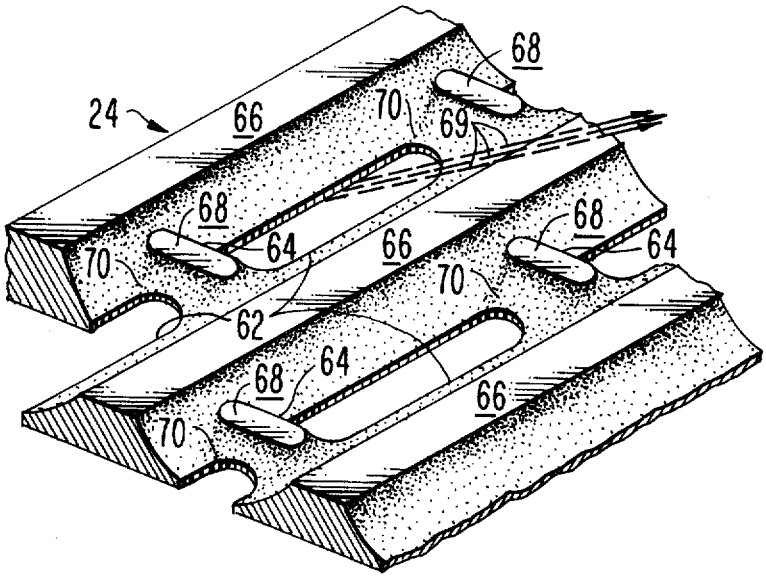
FIG. 4 is a partial perspective view of the present novel shadow mask.

The improved novel mask 24 is shown in FIG. 4. This mask 24 has columns of apertures 62 located in the same positions as does the prior art mask 40 of FIG. 3, with the apertures 62 in each column being separated by webs 64. The mask 24 has portions of full thickness and portions of reduced thickness. The portions of full thickness consist of strips 66 between the aperture columns and islands 68 at the webs 64. The strips 66 and the islands 68 are separated from each other by portions 70 of reduced thickness. The mask surface shown in FIG. 4 faces the tube screen whereas the opposite surface faces the electron gun. When formed into a domed shape (e.g. spherical or biradial) or cylinderical shape the strips 66 and islands 68 lie in a curved contour and are the closest parts of the mask 24 to the screen. In effect then, when viewed from the screen, a large portion of the webs 64 comprise islands set in troughs that extend the length of the aperture columns. Because of this design, all three electron beam rays 69 pass through the mask without impinging on the webs. Therefore, the mask transmission is increased and, since maximum thickness is maintained directly between the aperture throats, mask strength is not sacrificed.

Figure 5:
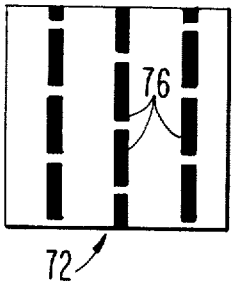
FIGS. 5 and 6 are photomaster patterns used for etching the gun side and the screen side aperture opening patterns, respectively, on opposite sides of a shadow mask.
Figure 6:
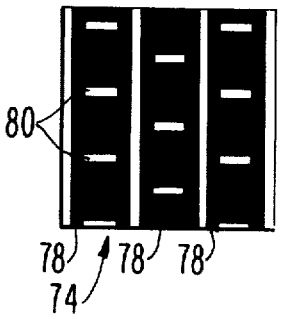

Photomaster patterns 72 and 74 which are used to form the apertures of the mask 60 of FIG. 4 are shown in FIGS. 5 and 6, respectively. The shaded areas in each pattern are the areas that are to be etched. The gun side pattern 72, shown in FIG. 5, consists of columns of dashes 76 at the aperture locations, whereas the screen side pattern 74 consists of side stripes 78 having horizontal clear portions 80 at the locations of the web islands.

Figure 7:
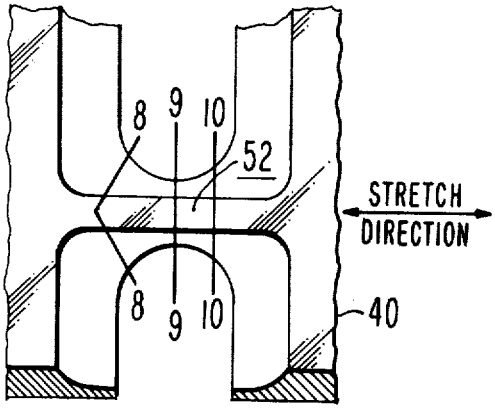
PRIOR ART Fig. 7.
FIG. 7 is a partial front view of a prior art shadow mask.
Figure 8:
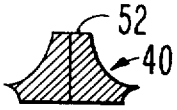
PRIOR ART Fig. 8.
FIGS. 8, 9 and 10 are sectional views of the prior art mask of FIG. 7 taken at lines 8—8, 9—9 and 10—10, respectively.
Figure 9:
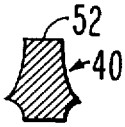
PRIOR ART Fig. 9.
Figure 10:
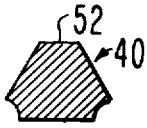
PRIOR ART Fig. 10.

The advantage of the present novel mask 24 over a prior art mask during forming of the mask into a domed shape can be appreciated by comparing web cross-sections. FIG. 7 shows the typical prior art mask 40 having a web 52 and web cross-sections taken at lines 8—8; 9—9 and 10—10 of FIG. 7 are shown in FIGS. 8, 9 and 10, respectively. As can be seen, the cross-sectional area of the web 52 at its center, line 9—9, is substantially less than the cross-sectional areas of the web 52 taken at lines 8—8 and 10—10. Because of this difference in cross-sectional area, the web 52 will stretch more in the vicinity of the cross-section 9—9 than at the other two cross-sections during forming of the mask 40. Such uneven stretching often results in rupturing of the webs during forming.

Figure 11:
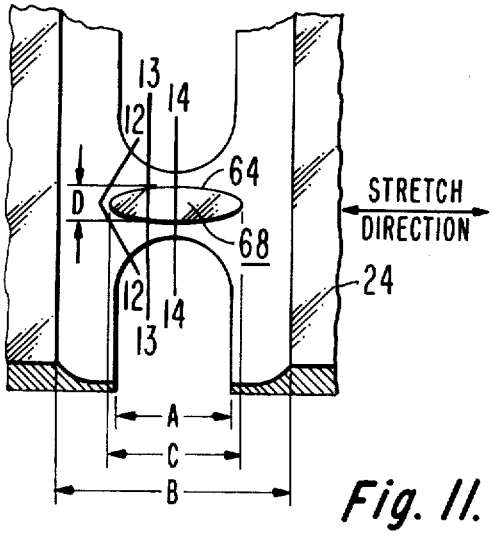
FIG. 11 is a partial front view of the present novel shadow mask.
Figure 12:
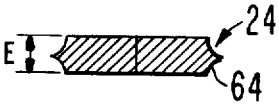
FIGS. 12, 13 and 14 are sectional views of the novel mask of FIG. 11 taken at lines 12—12, 13—13 and 14—14, respectively.
Figure 13:
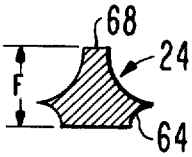
Figure 14:
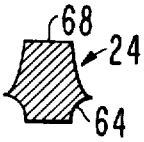

The present novel mask 24, having a web 68, is shown in FIG. 11 and web cross-sections taken at lines 12—12, 13—13 and 14—14 of FIG. 11 are shown in FIGS. 12, 13 and 14, respectively. In the mask 24, the cross-sections taken at different locations on the web 68 are substantially different in shape but all cross-sections have substantially the same cross-sectional areas of the web 68. There are no relatively weaker areas in the web 68 that may rupture during forming of the mask 24 into a domed shape. This advantage permits some reduction in web width, measured in the longitudinal direction of an aperture column, to be made thereby increasing mask transmission without substantially affecting the mechanical strength needed for mask formation and subsequent handling.

The following measurements were made on an experimental 19 inch (48.26 cm) diagonal shadow mask at the center of the mask.

| | Mils | mm |
|---|---|---|
| Aperture centerline column-to-column spacing | 35.50 | (.902) |
| Aperture length | 28.18 | (.716) |
| Vertical aperture center-to-center spacing | 32.00 | (.813) |
| Vertical aperture-to-aperture spacing (vertical web dimension) | 3.82 | (.097) |
| Aperture width ("A" in FIG. 11) | 6.65 | (.169) |
| Trough width ("B" in FIG. 11) | 17.83 | (.453) |
| Web island length ("C" in FIG. 11) | 7.03 | (.179) |
| Web island width ("D" in FIG. 11) | 2.37 | (.060) |
| Thickness of reduced thickness portion of web ("E" in FIG. 12) | 2.00 | (.051) |
| Mask and island thickness ("F" in FIG. 13) | 6.00 | (.152) |

What is claimed is:

1. In a color picture tube having a slit type apertured mask, wherein the slit apertures are arranged in columns and the apertures in each column are separated by webs, the improvement comprising said mask having portions of full thickness and other portions of reduced thickness, said portions of full thickness consisting of strips between the aperture columns and islands at the webs, the strips and islands being separated from each other by portions of reduced thickness.

2. In a color picture tube including an electron gun, a cathodoluminescent screen and a slit type mask, wherein the slit apertures are arranged in columns and the apertures in each column are separated by webs, the improvement comprising said mask having a first surface facing said electron gun and a second surface facing said screen said second surface having portions nearest said screen lying in a curved contour, the portions lying in the contour consisting of strips located between the aperture columns and islands located at said webs, the strips and islands being spaced from each other in said contour.

3. A color picture tube as defined in claim 2 wherein said contour is somewhat spherical.

4. The color picture tube as defined in claim 2 wherein said contour is biradial.

5. The color picture tube as defined in claim 2 wherein said contour is cylindrical.

6. In a color picture tube having a slit type apertured mask, wherein the slit apertures are arranged in columns and the apertures in each column are separated by webs, the improvement comprising said apertures being located in troughs extending the length of said columns with islands of greater thickness being located within the troughs at the webs.

7. In a color picture tube having a slit type apertured mask, wherein the slit apertures are arranged in columns and the apertures in each column are separated by webs, the improvement comprising each of said webs having substantially equal cross-sectional areas throughout each web.

8. The color picture tube as defined in claim 7 wherein the outer sides of said webs are of reduced thickness compared to the center of said webs.

* * * * *